US005112053A

United States Patent [19]

Brucker

[11] Patent Number: 5,112,053

[45] Date of Patent: May 12, 1992

[54] GOLF CLUB AND PLUMBING DEVICE THEREOF

[76] Inventor: Alexander Brucker, 1332 Prospect Hill Rd., Villanova, Pa. 19085

[21] Appl. No.: 689,461

[22] Filed: Apr. 22, 1991

[51] Int. Cl.[5] ..... A63B 69/36; A63B 53/00; G01C 9/14; G01C 9/28

[52] U.S. Cl. ..... 273/162 B; 273/165; 273/77 R; 273/81 C; 273/32 H; 33/334; 33/365; 33/397

[58] Field of Search ..... 273/32 R, 32 B, 32 H, 273/162 R, 162 B, 81.4, 77 R, 77 A, 165, 81.2, 81 C, 81 D; 33/263, 286, 313, 334, 354, 365, 373, 397

[56] References Cited

U.S. PATENT DOCUMENTS

| | | | |
|---|---|---|---|
| 615,781 | 12/1898 | Balser | 33/397 |
| 2,919,922 | 1/1960 | Skelly | 273/163 R |
| 3,186,092 | 6/1965 | Bertas | 273/163 A X |
| 3,293,755 | 12/1966 | Cronwell | 273/32 B |
| 3,881,259 | 5/1975 | Pigeon | 33/397 |
| 4,114,886 | 9/1978 | Koch | 273/162 B |
| 4,174,838 | 11/1979 | Pachetto | 273/163 A |
| 4,212,467 | 7/1980 | Shiratori | 273/163 A |
| 4,317,568 | 3/1982 | Green | 273/163 A |
| 4,482,155 | 11/1984 | Higley | 273/162 B |

*Primary Examiner*—George J. Marlo
*Attorney, Agent, or Firm*—Schechter, Brucker & Pavane

[57] ABSTRACT

A device (10) for facilitating use of the shaft (28) of a golf club (30) for plumbing is disclosed. The device comprises two concentric members (12, 16), one freely movable inside the other, with the inner member (16) seated about the shaft (28) of the club (30). Plumbing is achieved by gripping the outer member (12) between two or more fingers, whereupon the free movement of the inner member (16) relative to the outer member (12) permits the club (30) to assume a truly vertical orientation with the head (44) of the club (30) serving as a plumb weight. The shaft (28) may then be used to judge the relief of the putting surface in the usual manner, but with the assurance that the club (30) is in a true vertical orientation.

20 Claims, 1 Drawing Sheet

FIG. 1
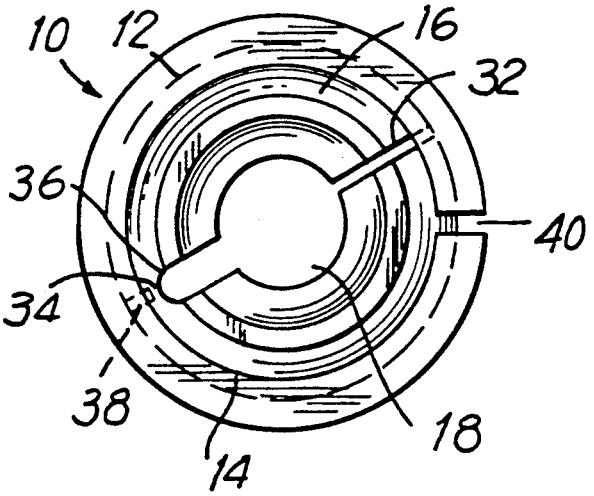
FIG. 3
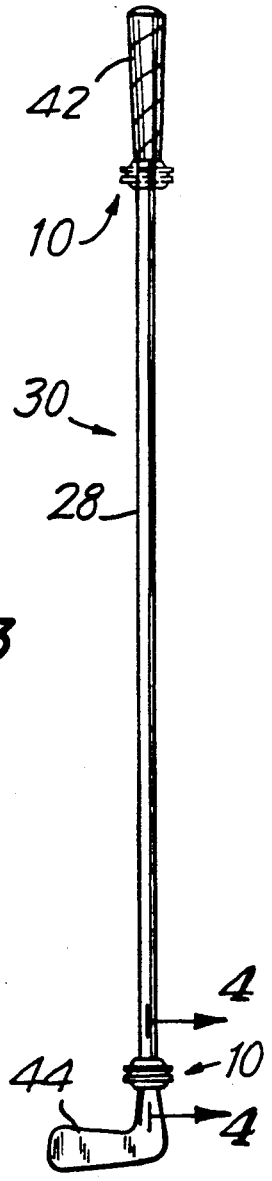
FIG. 2
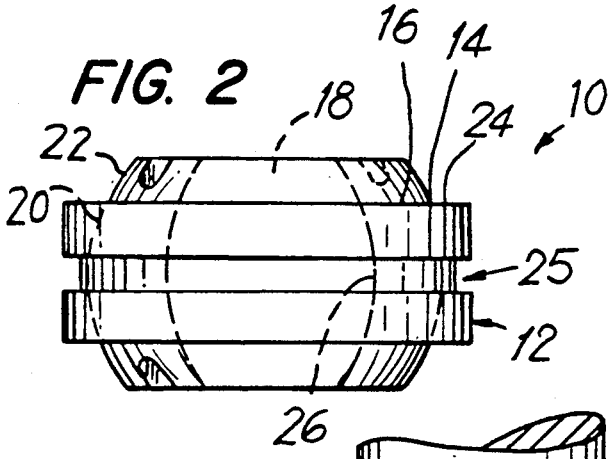
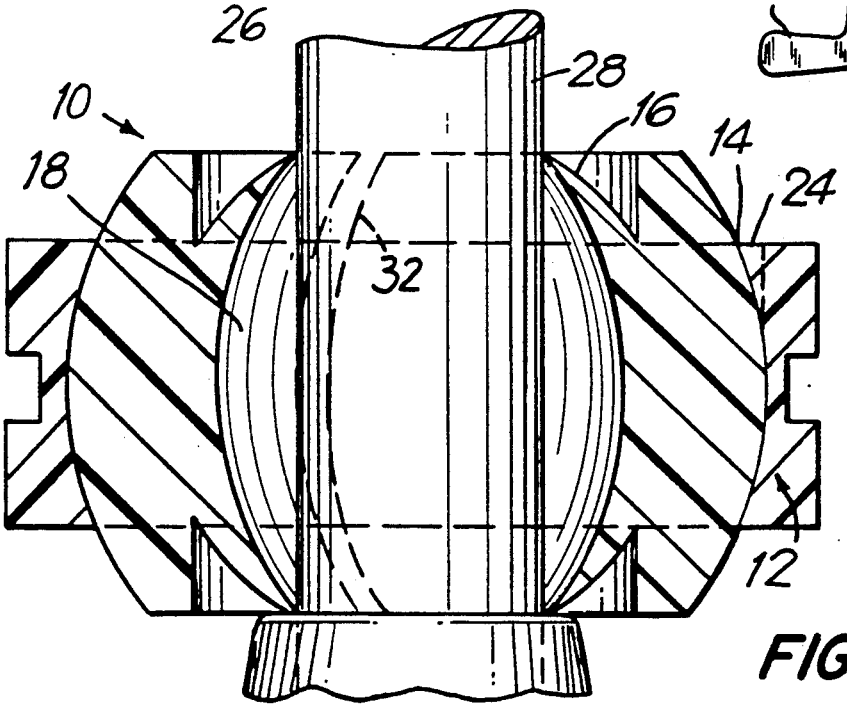
FIG. 4

GOLF CLUB AND PLUMBING DEVICE THEREOF

BACKGROUND OF THE INVENTION

1. Technical Field

This invention relates to a device used in golf, and more particularly to a device which facilitates use of a putter as a "plumb line" for aligning a putt.

2. Background Art

In the game of golf, putting the ball while it is on the green is challenging, particularly where the putting green is not flat. For accurate putting, an uneven relief requires an exact evaluation of the curvature of the surface of the putting green over which the ball will travel en route to the hole. Without such an evaluation, the player may choose the wrong direction to putt the ball, thereby adding strokes to his/her final score.

To evaluate the relief of the putting green, players typically use their golf clubs as a kind of "plumb line". This is accomplished by gently holding the handle of the golf club between the thumb and forefinger such that the club has sufficient freedom of movement to assume a vertical position under the influence of gravity, with the head of the club acting as the weight for the plumb line. This technique, however, is not perfect. No matter how gently the putter is held, freedom of movement of the club's shaft is invariably somewhat restricted by the user's fingers making a truly vertical orientation unlikely. And in the absence of a truly vertical orientation, assessment of the relief of the surface of the putting green is likely to be in error.

It is accordingly an object of the invention to provide a device for facilitating evaluation of the relief of a putting surface.

It is a further object of the invention to provide such a device which may be used in combination with a conventional golf club, typically a putter.

It is yet a further object of the invention to provide a device of the aforementioned type which is easy to use and inexpensive.

It is still a further object of the invention to provide a device of the aforementioned type which in use is fitted on a golf club and which may be removed therefrom as desired.

DISCLOSURE OF THE INVENTION

Briefly stated, the present invention is a device which facilitates use of the shaft of a golf club for plumbing, the device comprising two concentric members, one freely movable inside the other in the manner of gimbals, with the inner member seated about the shaft of the club. Plumbing is achieved by gripping the outer member between two or more fingers, whereupon the free movement of the inner member permits the club to assume a truly vertical orientation with the head of the club serving as a plumb weight. The shaft may then be used to judge the relief of the putting surface in the usual manner, but with the assurance that the club is in a true vertical orientation.

In a broad sense, the device of the invention comprises an inner member having an internal bore dimensioned to be seated about the shaft of a golf club and an outer member having an internal opening, the inner member being seated in the opening and freely movable relative to the outer member whereby when the inner member is seated on the shaft and the outer member is gripped by a user, the free movement of the inner member relative to the outer member permits the shaft to assume a vertical position for facilitating use of the club as a plumb line.

In another aspect, the invention comprises an improved golf club incorporating a device to facilitate use of the club for plumbing, the device comprising an inner member having an internal bore seated about the shaft of the golf club and an outer member having an internal opening, the inner member being seated in the opening and freely movable relative to the outer member whereby when the outer member is gripped by a user, the free movement of the inner member relative to the outer member permits the shaft to assume a vertical position for facilitating use of the club as a plumb line.

According to a preferred feature of the invention, the mating surfaces of the inner and outer members are curved to accommodate free rotation of the inner member relative to the outer member.

The above as well as further features and advantages of the present invention will be more fully apparent from the following detailed description read in conjunction with the accompanying drawings.

BRIEF DESCRIPTION OF THE DRAWINGS

FIG. 1 is a top plan view of a preferred embodiment of the device of the invention.

FIG. 2 is a side view thereof; and

FIG. 3 is a perspective view of a golf club fitted with the preferred device.

FIG. 4 is a cross-sectional view taken on the line 4—4 of FIG. 3.

BEST MODE FOR CARRYING OUT THE INVENTION

Referring now to the drawings, a device for plumbing in accordance with the present invention is generally designated at 10. As shown, the device 10 includes an outer generally ring-shaped member 12 defining an opening 14 and an inner generally toroidally-shaped member 16 defining a bore 18.

As best seen in FIGS. 1, 2 and 4, the internal wall 20 defining the opening 14 in the outer member 12 has a concave shape for receiving the generally convex outer wall 22 of the inner member 16. When the internal member 16 is received in the opening 14 of the outer member 12, the clearance between the walls 20 and 22 is sufficient to accommodate free rotational movement of the inner member 16 relative to the outer member 12. In the drawings, the clearance fit between the concave wall 20 of the outer member 12 and the convex wall 22 of the inner member 16 is designated by the space 24 which is exaggerated in FIG. 2 for purposes of clarity. As seen in the drawings, the wall 26 defining the bore 18 in the inner member 16 is dimensioned to fit about the shaft 28 of a golf club 30 as will be more fully explained below.

As best seen in FIGS. 1, 2 and 3, the inner member 16, which is preferably comprised of low-friction plastic, such as Teflon®, comprises a through slit 32 and a diametrically opposed living hinge 34, the latter comprising a narrowed section of the inner member defined between a slot 36 extending from the wall 26 and an aligned groove 38 in the outer wall 22. It will be apparent to those of ordinary skill in the art that this arrangement permits the two halves of the inner member 16 to be pivoted apart about the living hinge 34 for widening the slit 32. This, in turn, permits the inner member 16 to be fitted about the shaft 28 of a putter 30 by forcing the shaft 28 through the widened slit 32 until the shaft seats in the bore 18. As also best shown in FIG. 1, the outer member 12, which may be comprised of plastic, such as PVC, includes a through slit 40. This slit 40 allows the opening 14 in the outer member 12 to be sufficiently enlarged so that it may be fitted about the inner member 16 as will be more fully explained below. Outer member 12 also has an external, annular groove 25 shown in FIGS. 2 and 3 to receive a rubber band or spring for reasons also explained below.

To assemble the device 10 on the shaft 28 of the putter 30, the two halves of the inner member 16 are pivoted apart about hinge 34 until the slit 32 is sufficiently widened to fit about the shaft 28 for seating the shaft in the bore 18 whereupon the resiliency of the living hinge 34 closes the two halves of the inner member 16 about the shaft. Next, the outer member 12 is forced via slit 40 about the shaft 28 at a lower portion thereof, preferably below the inner member 16. The outer member 12 may then be slid up the shaft 28 into abutting relation with the inner member 16, whereupon continued upward pressure on the outer member 12 widens the opening 14, such widening being accommodated by the slit 40, until the outer member 12 snaps into position about the inner member 16. In this regard, it will be noted that the diameter of the convex wall 22 of the inner member 16 at its widest point is greater than the diameter of the opening 14 at either end thereof such that once the inner member 16 is seated in the outer member 12 it is retained therein. With the outer member 12 in place about the inner member 16, the clearance 24 between the inner and outer members accommodates free rotational movement therebetween. A rubberband or spring may be seated in the groove 25 in outer member 12 to insure that the amount of friction between the inner and outer members remains constant. Alternatively, some other form of fastening device may be employed to keep the slit 40 in outer member 12 closed.

The device 10 may seat at the very bottom of the shaft 28 which, as best shown in FIG. 3, is usually tapered from the gripping end 42 to the putting head 44 or, alternatively, may be retained by a friction fit or adhesion at the upper end of shaft 28 below grip 42. In either event, when it is desired to use the shaft 28 of the putter 30 as a plumb line for judging the relief of a putting surface, the device 10 will typically be positioned at the top of the shaft below the grip. If the device 10 is seated at the bottom of shaft 28, this is easily accomplished by sliding device 10 up the shaft 28 until the taper of the shaft blocks further upward sliding movement, i.e., when the diameter of the shaft 28 equals the diameter of the bore 18. If the taper of the shaft is insufficient to block further upward sliding movement, such upward movement will, in any event, be blocked by the handle 42 of the club. The user then grips the outer member 12 between two or more fingers without, however, touching either the inner member 16 or the putter 30 which are thereby free to move relative thereto. Such relative movement between the outer member 12 on the one hand and the inner member 16 and putter 30 on the other, much in the manner of gimbals, permits the putter 30 to assume a truly vertical orientation under the influence of gravity, with the head 44 of the club 30 serving as a plumb weight. At this point, the shaft 28 is used in the usual fashion as a plumb line for judging the relief of the putting green, but with the assurance that the club shaft 28 is in a truly vertical orientation. Of course, when plumbing, the head 44 should be pointed directly toward or away from the hole. Otherwise, the tilt of the club relative to true vertical resulting from the asymmetric weighting of the club head will affect the accuracy of the resulting plumb.

While I have herein shown and described a preferred embodiment of the present invention, those of ordinary skill in the art will recognize that various changes and modifications may be made therein without departing from the spirit and scope thereof. For example, while the preferred device 10 is comprised of plastic to accommodate removal of the device 10 from club 30 as desired, it could be made of, for example, metal in which event the device could be permanently fitted on the club. Accordingly, the above description should be construed as illustrative, and not in a limiting sense, the scope of the invention being defined by the following claims:

What is claimed is:

1. A device for use in golf comprising:

an inner member having an internal bore dimensioned to be seated about the shaft of a golf club; and an outer member having an internal opening, said inner member being seated in said opening and freely movable relative to the outer member whereby when the inner member is seated on the shaft and the outer member is gripped by a user, the free movement of the inner member relative to the outer member permits the shaft to assume a vertical position for facilitating use of said club as a plumb line.

2. The device of claim 1, wherein the wall of said outer member defining said internal opening is generally concave and the outer wall of said inner member received in said opening is generally convex whereby the cooperation of said concave and convex walls retains said inner member in said opening while permitting free movement of said inner member relative to said outer member.

3. The device of claim 2, wherein said inner member is generally toroidally-shaped and said bore is an axial bore, and wherein said outer member is generally ring-shaped and said opening is an axial opening.

4. The device of claim 2, wherein said outer member is resilient and has a first through slit therein for accommodating widening of said opening for receiving said inner member.

5. The device of claim 4, wherein said inner member is resilient and has a second through slit therein which may be widened sufficiently to accommodate insertion of said shaft into said bore through said second slit.

6. The device of claim 5, wherein said inner member has a living hinge opposite said second through slit for accommodating widening thereof.

7. The device of claim 5, wherein said inner and outer members are made of plastic.

8. The device of claim 7, wherein said inner member comprises a low friction plastic.

9. The device of claim 7, wherein said outer member comprises PVC.

10. The device of claim 2, wherein said device is intended for use with a club having a tapered shaft narrower at its club head than its handle, and wherein said bore is dimensioned for a clearance fit about said shaft near said club head and a friction fit about said shaft near said handle whereby when said device is in use it is near said handle and retained against further upward movement by said friction fit.

11. In a golf club, the improvement comprising a device to facilitate use of said club for plumbing, comprising:

an inner member having an internal bore seated about the shaft of said golf club; and an outer member having an internal opening, said inner member being seated in said opening and freely movable relative to the outer member, whereby when the outer member is gripped by a user, the free movement of the inner member relative to the outer member permits the shaft to assume a vertical position for facilitating use of said club as a plumb line.

12. The device of claim 11, wherein the wall of said outer member defining said internal opening is generally concave and the outer wall of said inner member received in said opening is generally convex whereby the cooperation of said concave and convex walls retains said inner member in said opening while permitting free movement of said inner member relative to said outer member.

13. The device of claim 12, wherein said inner member is generally toroidally-shaped and said bore is an axial bore, and wherein said outer member is generally ring-shaped and said opening is an axial opening.

14. The device of claim 12, wherein said outer member is resilient and has a first through slit therein for accommodating widening of said axial opening for receiving said inner member.

15. The device of claim 14, wherein said inner member is resilient and has a second through slit therein which may be widened sufficiently to accommodate insertion of said shaft into said bore through said second slit.

16. The device of claim 15, wherein said inner member has a living hinge opposite said second through slit for accommodating widening thereof.

17. The device of claim 15, wherein said inner and outer members are made of plastic.

18. The device of claim 17, wherein said inner member comprises a low friction plastic.

19. The device of claim 17, wherein said outer member comprises PVC.

20. The device of claim 12, wherein said golf club has a tapered shaft narrower at its club head than its handle, and wherein said bore is dimensioned for a clearance fit about said shaft near said club head and a friction fit about said shaft near said handle, whereby when said device is in use it is near said handle and retained against further upward movement by said friction fit.

* * * * *